US005988352A

United States Patent [19]

Ballestrazzi et al.

[11] Patent Number: 5,988,352

[45] Date of Patent: Nov. 23, 1999

[54] DEVICE FOR TURNING AN EDITORIAL PRODUCT ON A PACKAGING LINE

[75] Inventors: Aris Ballestrazzi; Lamberto Tassi, both of Savignano Sul Panaro, Italy

[73] Assignee: Sitma S.p.A., Spilamberto, Italy

[21] Appl. No.: 08/888,102

[22] Filed: Jul. 3, 1997

[30] Foreign Application Priority Data

Jul. 16, 1996 [IT] Italy ..... MI960508 U

[51] Int. Cl.[6] ..... B65G 47/24

[52] U.S. Cl. ..... 198/405; 270/58.07; 270/58.29

[58] Field of Search ..... 198/405; 270/58.05, 270/58.07, 58.11, 58.29

[56] References Cited

U.S. PATENT DOCUMENTS 3,520,395 7/1970 Jablonski et al. ..... 270/58.07
3,825,247 7/1974 Fernandez-Rana et al. ..... 270/58.29

FOREIGN PATENT DOCUMENTS 0 240 691 10/1987 European Pat. Off. .
0 627 376 12/1994 European Pat. Off. .
86 15 853 12/1986 Germany .

*Primary Examiner*—Jospeh E. Valenza
*Attorney, Agent, or Firm*—Oblon, Spivak, McClelland, Maier & Neustadt, P.C.

[57] ABSTRACT

A device for turning an editorial product on a packaging line includes a pusher conveyor, a feeder for products to be packaged, and a plurality of feeders for sheet inserts for the products, arranged side by side one after another along a direction essentially perpendicular to the pusher conveyor. The device has a base on which there is mounted a unit for gripping, rotating, overturning through 180° and guiding the products caused to advance by the pusher conveyor. The base has an overall size identical to that of one of the insert feeders so as to be able to assist in its position within the line. A drive is also provided for the unit.

3 Claims, 3 Drawing Sheets

11
12
12'
12"
13
14
15
17
18
19
20
21
22
23
25
26
27
31
32
33
34

11
13
16
17
23
24
26

Fig.3
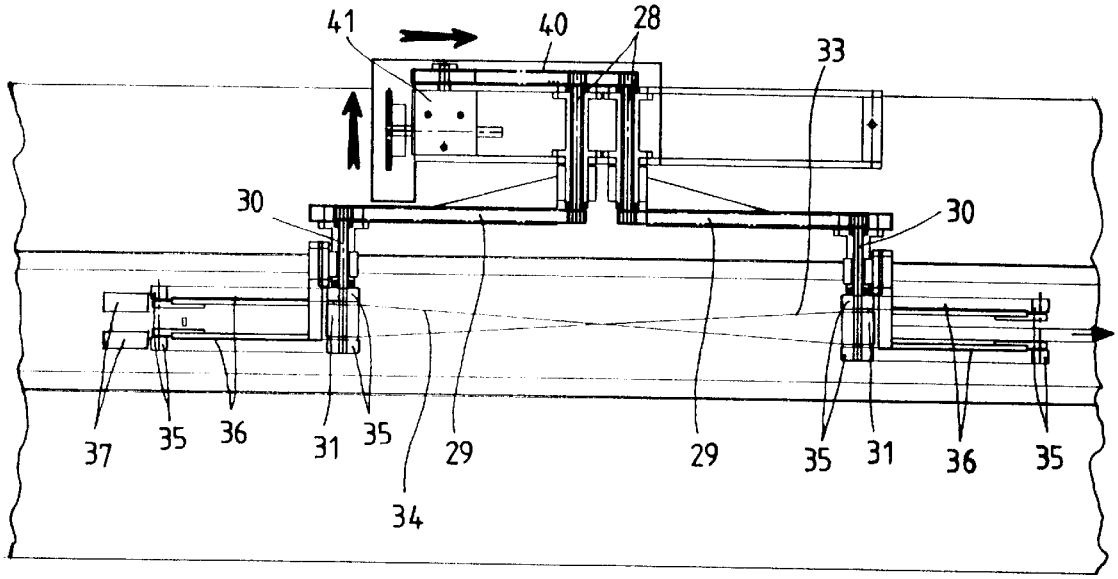
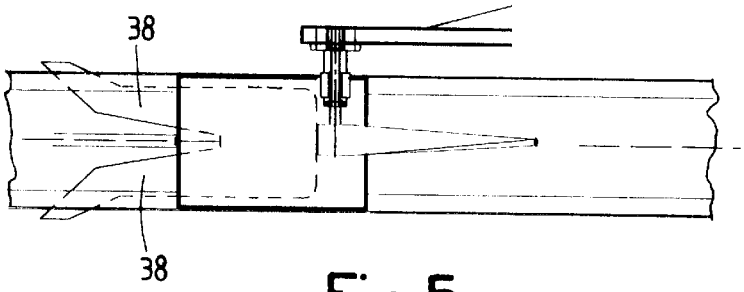
Fig.5

DEVICE FOR TURNING AN EDITORIAL PRODUCT ON A PACKAGING LINE

BACKGROUND OF THE INVENTION

1. Field of the Invention

This invention relates to a device for turning an editorial product on a packaging line.

2. Discussion of the Related Art

On packaging lines or machines for flat graphic or editorial products such as sheets, signatures, magazines, brochures etc., it is nearly always necessary to be able to associate further sheet elements, generally defined as inserts, with these products.

Moreover, these inserts have to be located in correspondence with a particular position or side of the product according to their importance and according to the type of impact which they are required to have on the purchaser of the finished package, complete with the relative inserts.

Consequently, a separate device for overturning the product is associated with the end of the packaging line and it aligned therewith. In this manner the overturned product is fed towards a second packaging line on which every additional insert is combined with a different side of the product, before passing to the unit for its packaging within a plastic film or a suitable paper sheet.

This type of procedure does not satisfy the requirement of feeding such inserts in a certain number onto different sides of a base product as additions thereto, at a high operating rate. It also requires the use of a number of lines and devices, with considerable capital expenditure and consequent costs.

On the other hand, up to the present time, single packaging lines have used only the so-called drum feeders which are positioned to the side of the line pusher conveyor to feed the individual inserts only onto the editorial base product in the position n which it is fed. This arrangement results in the aforesaid drawbacks.

SUMMARY OF THE INVENTION

An object of the present invention is to feed sheet inserts in the most rapid manner possible towards different sides of a product to be packaged, within the same packaging line or machine.

A further object is to correctly achieve this feed after a predetermined number of inserts have already been fed, this number being variable and predetermined on the basis of the particular requirements of the client ordering the package.

These objects are attained according to the present invention by a device for turning an editorial product on a packaging line comprising a pusher conveyor, a feeder for products to be packaged, and a plurality of feeders for sheet inserts for said products, arranged side by side one after another along a direction essentially perpendicular to said pusher conveyor, said device being characterised by a base on which there is mounted a unit for gripping, rotating, overturning through 180° and guiding said products caused to advance by said pusher conveyor, and for depositing said thus turned products onto said conveyor, said base having an overall size identical to that of one of said insert feeders so as to be able to assist it in its position within said line, drive means being provided for said unit.

The characteristics an advantages of a device for turning an editorial product on a packaging line according to the present invention will be more apparent from the description thereof given hereinafter by way of an example, with reference to the accompanying schematic drawings;

BRIEF DESCRIPTION OF THE DRAWINGS

FIG. 3 is a partly sectional enlarged plan view from above of a detail of FIG. 2, showing the device of the present invention;

FIG. 5 is a plan view of a further embodiment of insertion elements within the device.

DETAILED DESCRIPTION OF THE INVENTION

Figure 1:
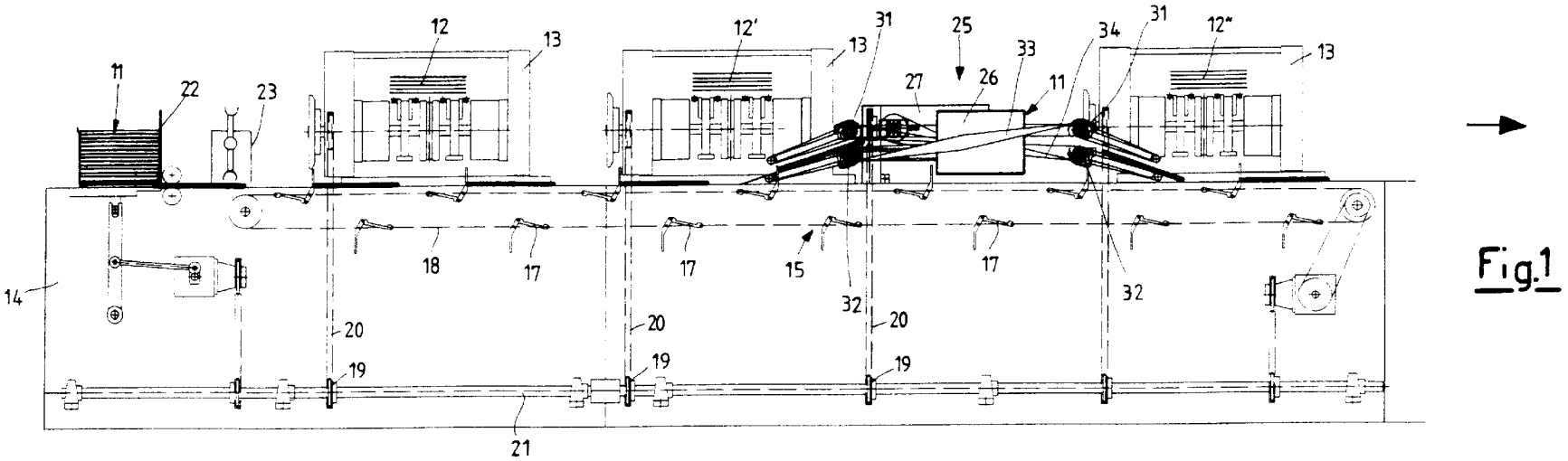
FIG. 1 is a schematic side elevation of a device according to the present invention inserted into a packaging line to the side of a pusher conveyor.
Figure 2:
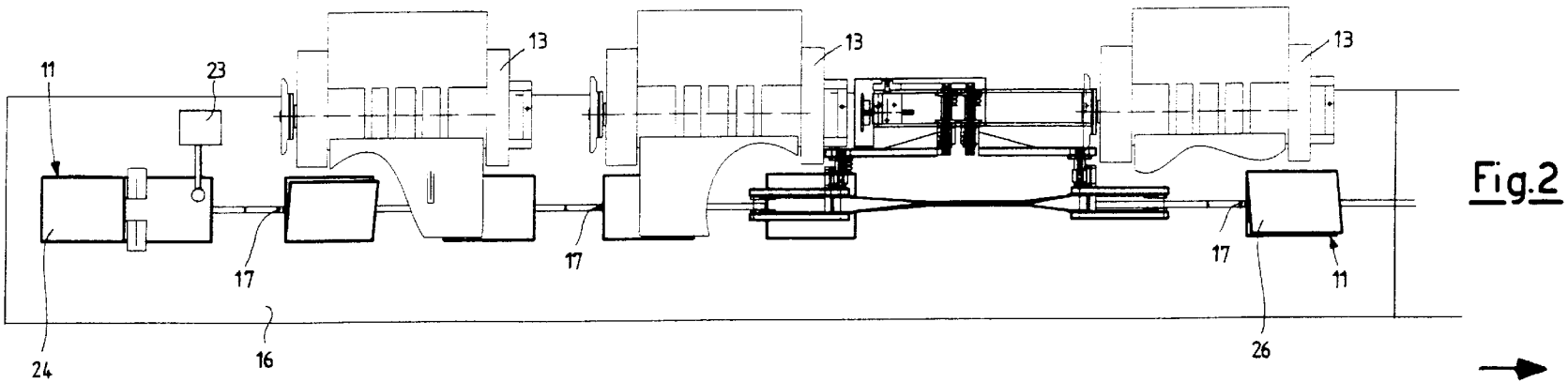
FIG. 2 is a plan view of FIG. 1 from above, some parts being removed to facilitate comprehension.

FIGS. 1 and 2, show very schematically a packaging line for flat graphic and editorial products 11, such as double-sided sheets, signatures, magazines, brochures;

There is nearly always the requirement of being able to associate with these products further sheet elements known generally as inserts, and indicated by 12, 12', 12". The inserts 12, 12', 12" are fed by a certain number of feeders, such as drum or other feeders 13, usually positioned to the side of the packaging line. The drum feeders 13 are positioned on a general support structure 14 to the side of a conveyor 15 composed of a support and guide surface 16 in FIG. 2, possibly in the form of a channel, on which there slide a plurality of pushers 17, driven for example by an underlying endless flat chain 18 seen in FIG. 1. The surface of said conveyor 15 is hence able to receive a series of sheet inserts 12, 12', 12" originating from the lateral drum feeders 13, which in the illustrated example are three in number.

The drum feeders 13 are driven by chains 20 and relative gears 19 positioned on an underlying central transmission shaft 21 able to synchronously drive nearly all of the devices of the packaging line or machine. in this respect, the transmission shaft 21 also drives a vertical magazine feeder 22 which is positioned at the initial end of the line, where the base products 11 are inserted.

Downstream of the magazine feeder 22, there is positioned a device 23 for opening the first page, known as the first cover side, of the editorial product 11. The product maintained open in this manner is then fed in front of a first drum feeder 13, where it receives a first insert 12 below the first page 24. The same procedure can then take place in correspondence with the second drum feeder 13 for a second insert 12'.

On the packaging line or machine, there is also located a device 25 for turning an editorial product, formed in accordance with the present invention.

It will be noted that advantageously, according to the present invention, the device 25 for turning a product 11 overturns the advancing products while maintaining heir direction of travel ard the pitch set for the packaging line unaltered.

The reason for this action is to make it subsequently possible to zeros further inserts, for example 12", below or above the upper face of the overturned product. The terms used for these sides are the "third cover side" for the upper inner side and the "fourth cover side" for the upper outer side of the overturned product 26.

The device 25 comprises a base 27 having the same maximum dimension as the insert feeder or drum feeder 13, and hence able to be inserted into a space corresponding to it.

The base 27 carries a gripping, rotating, 180° turning and guiding unit for products 11 caused to advance by the pusher conveyor 15, in order to again deposit them inverted or turned on the conveyor. As shown in FIG. 3, the unit comprises four shafts 28 which act as fulcrums and support four arms 29 positionable by rotation according to requirements, the position of some or all the shafts 28 being height-adjustable. Each arm 29 carries at its free end, on a further shaft 30, a rotatable idle roller 31 or a motorized roller 32 seen in FIG. 1. The rollers 31 on the two upper arms 29 in FIG. 3 are idle, whereas those roller 32 on the two lower arms 29 are motorized. Each pair of rollers 31 and 32 supports and accompanies the movement of a relative conveyor belt 33 and 34 which turns about itself through 180°. In this manner the belts 33 and 34 face each other, they turn about themselves through 180°, and their opposite ends are aligned with the pusher conveyor. Specifically, in FIG. 1 the first belt 33 extends, in the direct,on of movement of the products, from a motorized lower roller 32 to an idle upper roller 31, and the second belt 34 extends from an idle upper roller 31 to a motorized lower roller 32.

Figure 4:
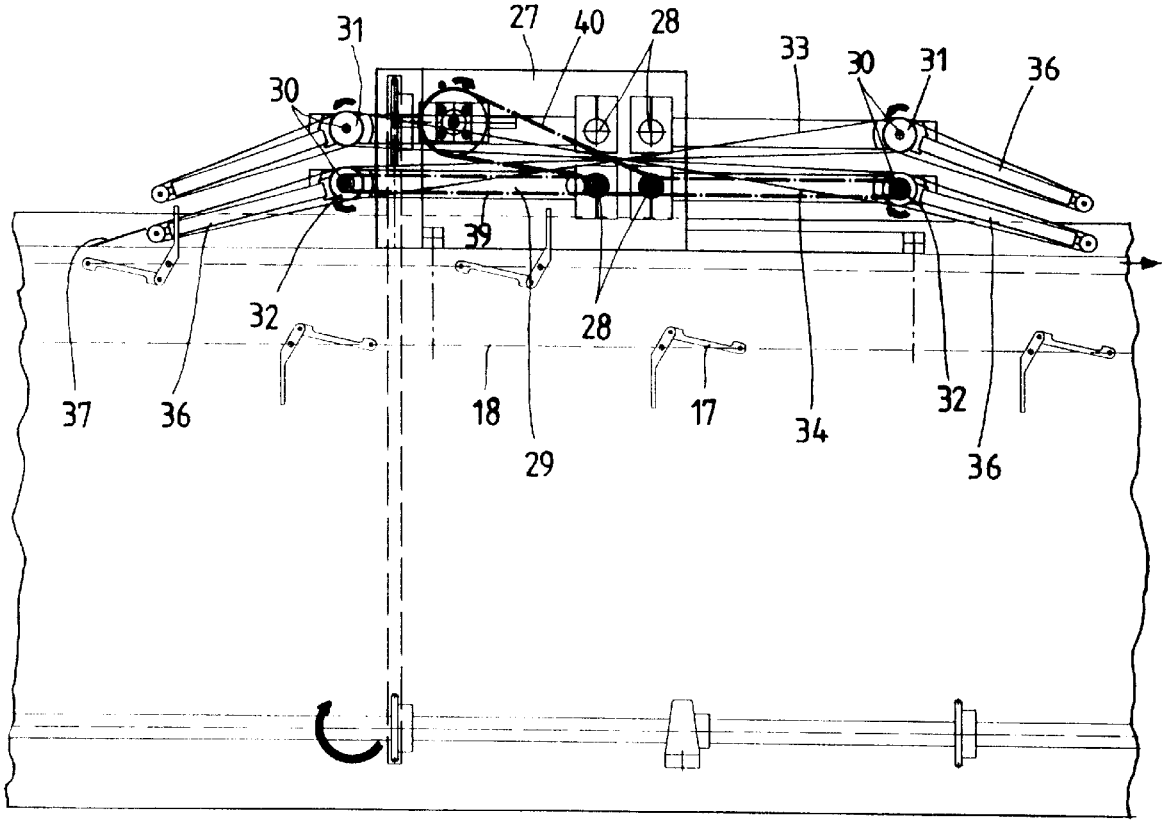
FIG. 4 is an enlarged side elevation of the detail of FIG. 3, but without the product inserted vertically between the belts as shown in FIG. 1.

As shown in FIG. 4, the rotary movement is transmitted to the belts 33 and 34, or to the rollers 32, by transmissions 39 which derive their movement from pulleys positioned an the shafts 28 which are driven by a further transmission 40. The transmission 40 is driven by a bevel gear pair 41 seen only in FIG. 3 and operated by the chain 20 of FIG. 3, the driven by the gear 19 rigid with the underlying central shaft 21.

In FIG.3, the shafts 30, protecting from the arms 29, also carry pairs of pulleys 35 located on opposite sides of the rollers 31, about which there extend portions of further pairs of smaller-dimension upper and lower belts 36 which face each other and are directed outwards from the device in the conveying direction of the products. The belts 36, which are also driven by the rotation of the shafts 30, form elements for the insertion of the products into the device.

By of the device 25 shown in FIG. 1 of the present invention, the upperly positioned first page or first cover side of the products 11 becomes positioned lowerly. Simultaneously the fourth page or fourth cover side, which was positioned lowerly, becomes positioned upperly. The provision of belts 33 and 34 arranged in this manner to grip between them the product 11 and relative inserts 12 and 12' located in it enables it to be overturned according to requirements without allowing the inserts contained within it to escape.

In this manner, a further insert 12", fed by a third drum feeder 13 in the embodiment illustrated in FIGS. 1 and 2, can be deposited onto the fourth cover side. This happens if the product 11, already containing possible inserts 12, 12', is simply rotated through 180° by the device 25 of the present invention.

Alternatively, if a further device for opening the fourth page of the editorial product 11 is provided similar to the opening devise 23, the insert 12" becomes positioned below he third page or third cover side, not shown.

The same can be achieved for further inserts by providing further drum feeders 13.

To facilitate the positioning and feeding of the products in FIG. 3 between the belts 36, a sheet metal or similar guide 37 is provided smoothly connecting the conveyor to the interior of the belts 36. Indeed, the belts 36 could be dispensed with, as in FIG. 5, and be replaced by simple sheet metal guides 38 starting from the conveyor and extending into proximity in FIG. 4 with the belts 33 and 34 which form the unit for gripping, rotating, overturning and guiding the products received in this manner. Thus the position of the device can be chosen to determine the number of inserts to be inserted before and/or after the turning or overturning of the fed products.

A device in accordance with the present invention hence enables the movement of the products within the packaging liner or machine to be utilized to achieve turning or overturning of the products and to directly insert the required inserts. Moreover, these inserts are positioned where specifically requested and in the number chosen by the custom requesting the packaging.

Besides achieving a greater operating speed of the entire line or machine, this particular arrangement enables the desired number of insert feeders or drum feeders to be provided and the turning device to be positioned in the required position where product turning is necessary. In this respect, the overall size of the device of the invention is such that it can be post positioned anywhere as a simple assisting mechanism for an insert feeder or drum feeder without any adaptation, and can do so by simple mechanical positioning and connection to the central control members.

Providing a power take-off fro the machine or line central shaft 21 in FIG. 1 enables complete and constant phasing to be achieved between the products and inserts 12 on a single machine, even at high speed. The connection to the a central shaft 21 hence mechanically achieves synchronized movement of the various elements and various devices, with correlation between their peripheral speeds.

We claim:

1. A device for turning an editorial product on a packaging line having a pusher conveyor, a feeder for products to be packaged, and a plurality of feeders for sheet inserts for said products arranged side by side one after another along a direction essentially perpendicuilar to said pusher conveyor, said device comprising:

a base on which re is mounted a unit for gripping rotating, overturning through 180° and guiding said products caused to advance by said pusher conveyor, and for depositing said thus turned products onto said conveyor, said base having an overall size identical to that of a base of said insert feeders so as to be able to assist in its position within said line;

wherein said gripping rotating, 180°-overturning and guiding unit includes a pair of mutually facing belts which turn about themselves through 180°, their opposite ends being aligned with said pusher conveyor; and wherein said pair of mutually facing belts pass about respective rollers positioned rotatably in proximity to one end of arms pivoted to an end of said base.

2. A device as recited in claim 1 further comprising:

transmissions which control peripheral speed of said belts in synchronism with said pusher conveyor.

3. A device as recited in claim 1, wherein said pivoted arms are adjustable in position.

* * * * *

UNITED STATES PATENT AND TRADEMARK OFFICE

CERTIFICATE OF CORRECTION

PATENT NO. : 5,988,352

DATED : November 23, 1999

INVENTOR(S): Aris BALLESTRAZZI, et al.

It is certified that an error appears in the above-identified patent and that said Letters Patent is hereby corrected as shown below:

On the title page, item [30], should read:

--[30] Foreign Application Priority Data

Jul. 16, 1996 [IT] Italy ..... MI96/U 000508 --

Signed and Sealed this

Twenty-sixth Day of December, 2000

*Attest:*

Q. TODD DICKINSON

*Attesting Officer*

*Director of Patents and Trademarks*